US006250957B1

(12) United States Patent
Chang

(10) Patent No.: US 6,250,957 B1
(45) Date of Patent: Jun. 26, 2001

(54) STACKED MODULAR JACK ASSEMBLY

(75) Inventor: Yao-Hao Chang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/357,582

(22) Filed: Jul. 20, 1999

(30) Foreign Application Priority Data

Nov. 3, 1998 (TW) ..... 87218245

(51) Int. Cl.[7] ..... H01R 13/66
(52) U.S. Cl. ..... 439/541.5
(58) Field of Search ..... 439/541.5, 676, 439/701, 79, 752–753

(56) References Cited

U.S. PATENT DOCUMENTS 4,653,837 * 3/1987 Philiipson et al. ..... 439/676
5,647,765 * 7/1997 Haas et al. ..... 439/676
5,647,767 * 7/1997 Scheer et al. ..... 439/676
5,766,043 * 6/1998 Talend ..... 439/676
5,989,069 * 11/1999 Tan et al. ..... 439/620
6,012,954 * 1/2000 Wu ..... 439/753

* cited by examiner

*Primary Examiner*—Neil Abrams
*Assistant Examiner*—J. F. Duverne
(74) *Attorney, Agent, or Firm*—Wei Te Chung

(57) ABSTRACT

A stacked modular jack assembly comprises a dielectric housing, a Z-shaped insert retained in the housing, a number of first and second contacts securely received in the housing by the insert, a grounding plate positioned between the first and second contacts and a shield enclosing the housing. The housing forms a rearward extending projection having a number of channels for receiving the first contacts. The insert comprises a body having a number of vertical cavities and a slot proximate the cavities, a tongue having a number of level passages and a tail having a number of notches for further retaining the first contacts. The second contacts are assembled to the insert with mounting portions thereof received in corresponding cavities and retaining portions thereof received in corresponding passages.

11 Claims, 8 Drawing Sheets

STACKED MODULAR JACK ASSEMBLY

BACKGROUND OF THE INVENTION

The present invention relates to an electrical connector, and particularly to a stacked modular jack assembly.

Stacked modular jacks are well known in the electronics field. U.S. Pat. Nos. 4,703,991; 4,202,593; 4,669,595; 4,786,259; 4,618,207 and Taiwan Patent Application No. 83200722 disclose such connectors. A conventional stacked modular jack generally comprises a dielectric housing, a plurality of first and second conductive contacts, first and second individual inserts and a shield covering the housing. The first and second contacts are secured to the housing by the first and second inserts whereby the modular degree of the jack is reduced and manufacture is complicated. In addition, the first and second contacts are closely positioned in the housing and no protecting means is provided; thus, cross talk occurs therebetween during high speed signal transmission through the first and second contacts. Hence, an improved electrical connector is required to overcome the disadvantages of the prior art.

BRIEF SUMMARY OF THE INVENTION

A first object of the present invention is to provide a stacked modular jack assembly having a single insert for securing both first and second contacts to a dielectric housing.

A second object of the present invention is to provide a stacked modular jack assembly having a grounding plate positioned between the first and second contacts to prevent cross talk therebetween.

In order to achieve the purposes stated above, a stacked modular jack assembly comprises a dielectric housing, a plurality of first and second contacts, an insert retaining the first and second contacts in the housing, a grounding plate for preventing cross talk between the first and second contacts and a shield covering over the housing. The housing forms a rearward extending projection having a plurality of channels on a top face thereof and a slit for receiving the plate, a pair of guiding recesses and a pair of latches on a rear portion thereof for engaging with the insert. The insert is a Z-shaped component comprising a body, a tongue projecting from a top edge of the body in one direction and a tail projecting from a bottom edge of the body in an opposite direction. The body forms a vertical slot for receiving the plate and a pair of wedges on opposite sidewalls thereof for securing the insert to the housing. The tongue forms a plurality of level passages in a top face thereof and a pair of guiding bars projecting from opposite edges thereof. The tail forms several first notches recessing a distance toward the body and several second notches recessing a shallower distance toward the body. The first and second notches are alternately arranged. The insert further forms a plurality of barriers extending from a bottom face of the tongue and a front face of the body. The grounding plate comprises a cover, an interfering portion perpendicularly extending from an edge of the cover and a soldering portion extending from the interfering portion. The interfering portion forms a plurality of barbs on opposite edges thereof.

In assembly, the second contacts are received in the insert with retaining portions thereof being received in the corresponding passages of the insert and free ends thereof being separated from each other by the barriers for preventing contact therebetween. The grounding plate is assembled to the insert with the barbs of the interfering portion interfering with a periphery of the slot of the insert. Then the insert together with the second contacts and the plate is smoothly assembled to the housing and guided by the bars thereof sliding along the recesses of the housing and engaged with the housing by the wedges thereof coupling with the latches of the housing. The first contacts are received in the housing with retaining portions thereof received in the corresponding channels of the insert and mounting portions received in the first and second notches in two rows. The cover is received in the slit of the housing.

Other objects, advantages and novel features of the invention will become more apparent from the following detailed description of the present embodiment taken in conjunction with the accompanying drawings.

DETAILED DESCRIPTION OF THE INTENTION

Figure 1:
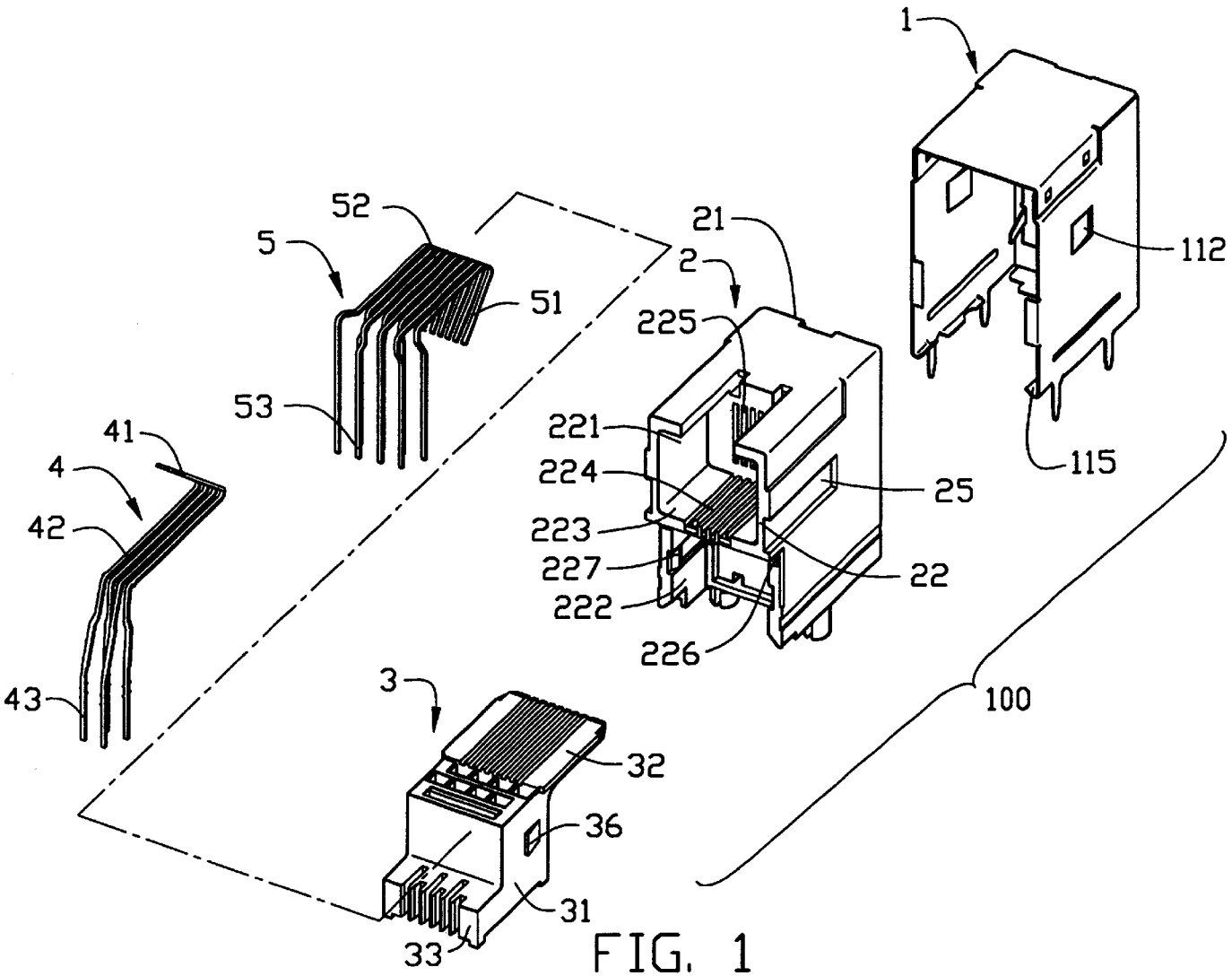
FIG. 1 is an exploded view of a stacked modular jack assembly in accordance with a first embodiment of the present invention.
Figure 2:
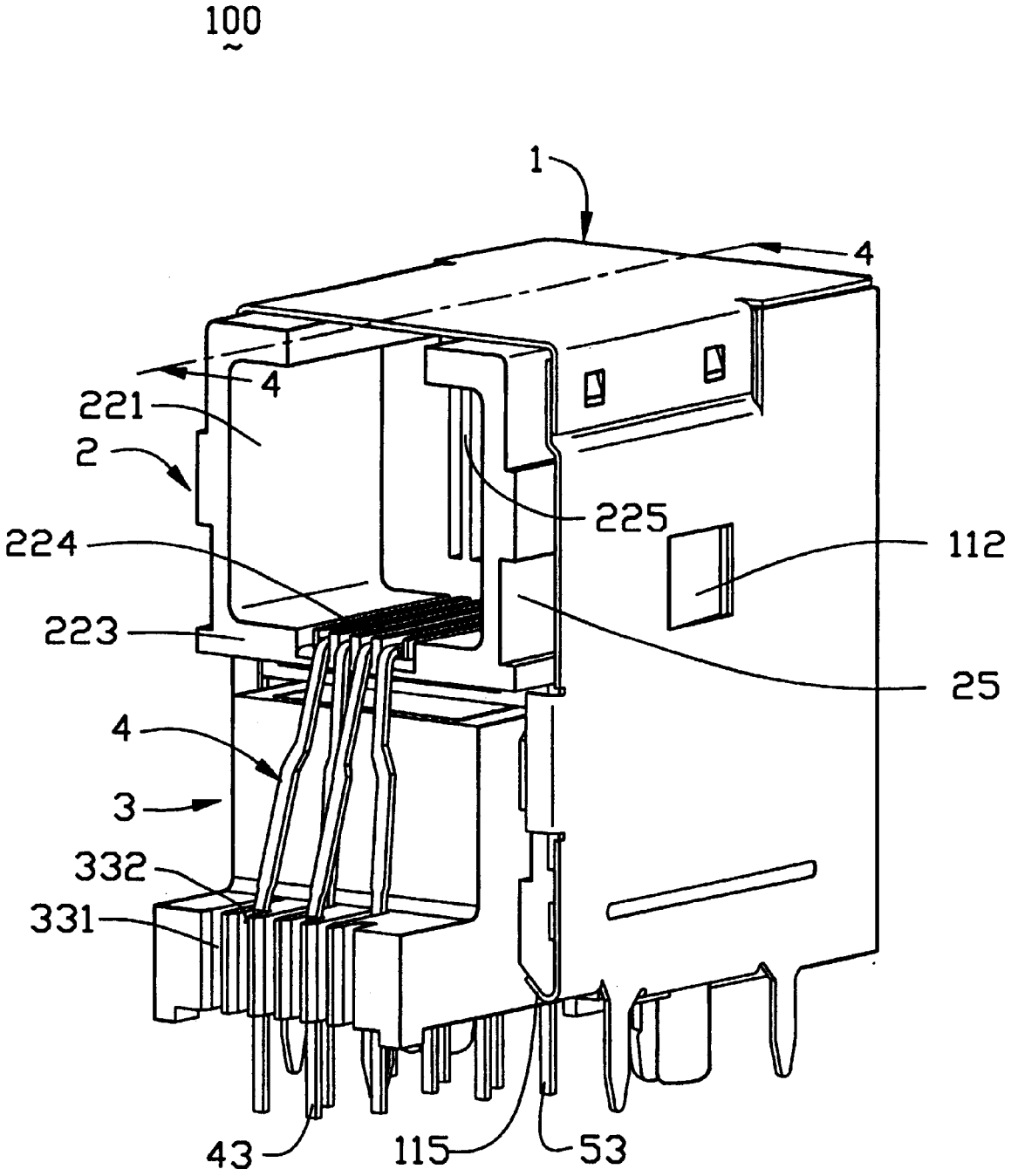
FIG. 2 is an assembled view of FIG. 1.
Figure 3:
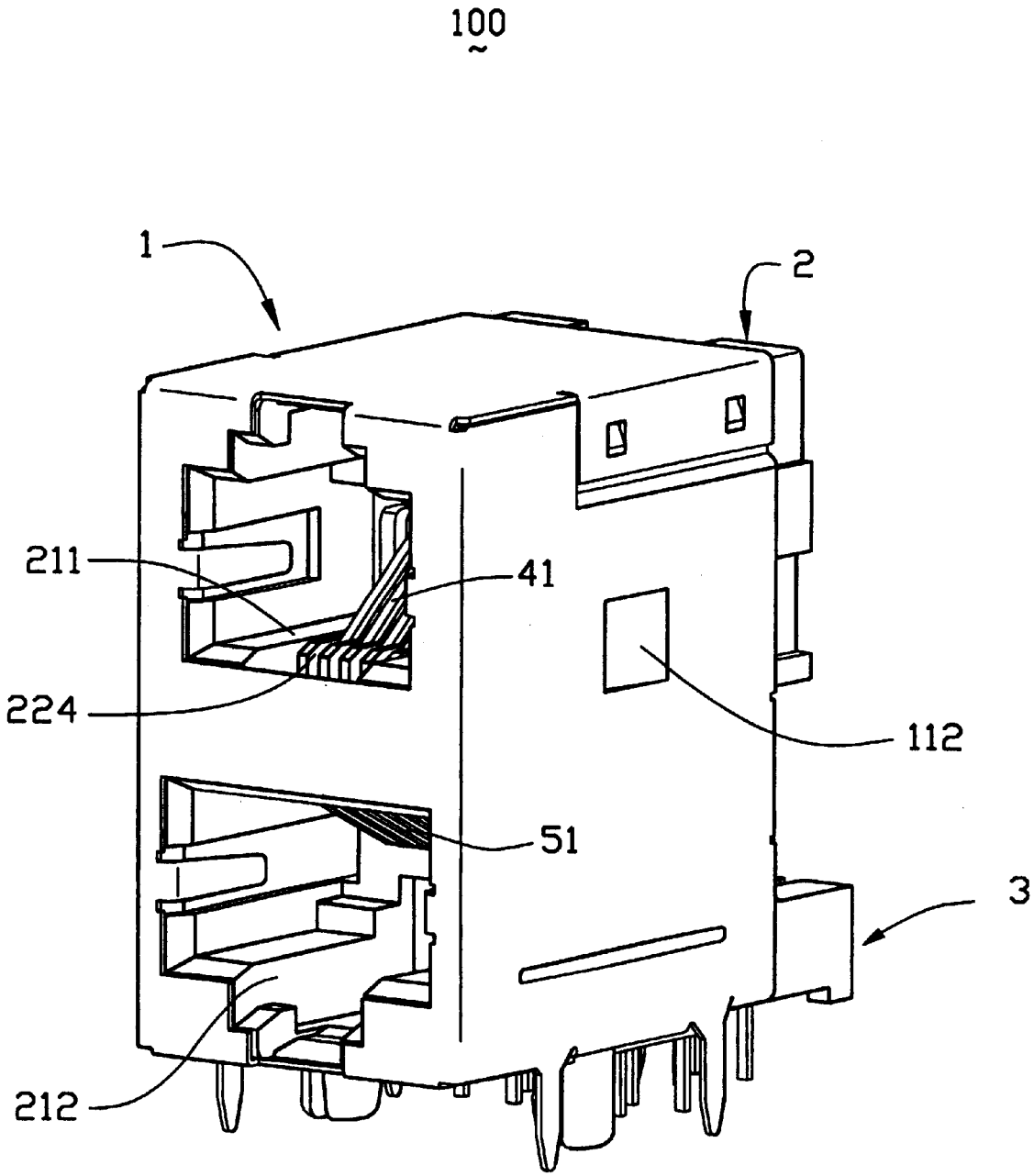
FIG. 3 is a view similar to FIG. 2 but taken from a different perspective.
Figure 4:
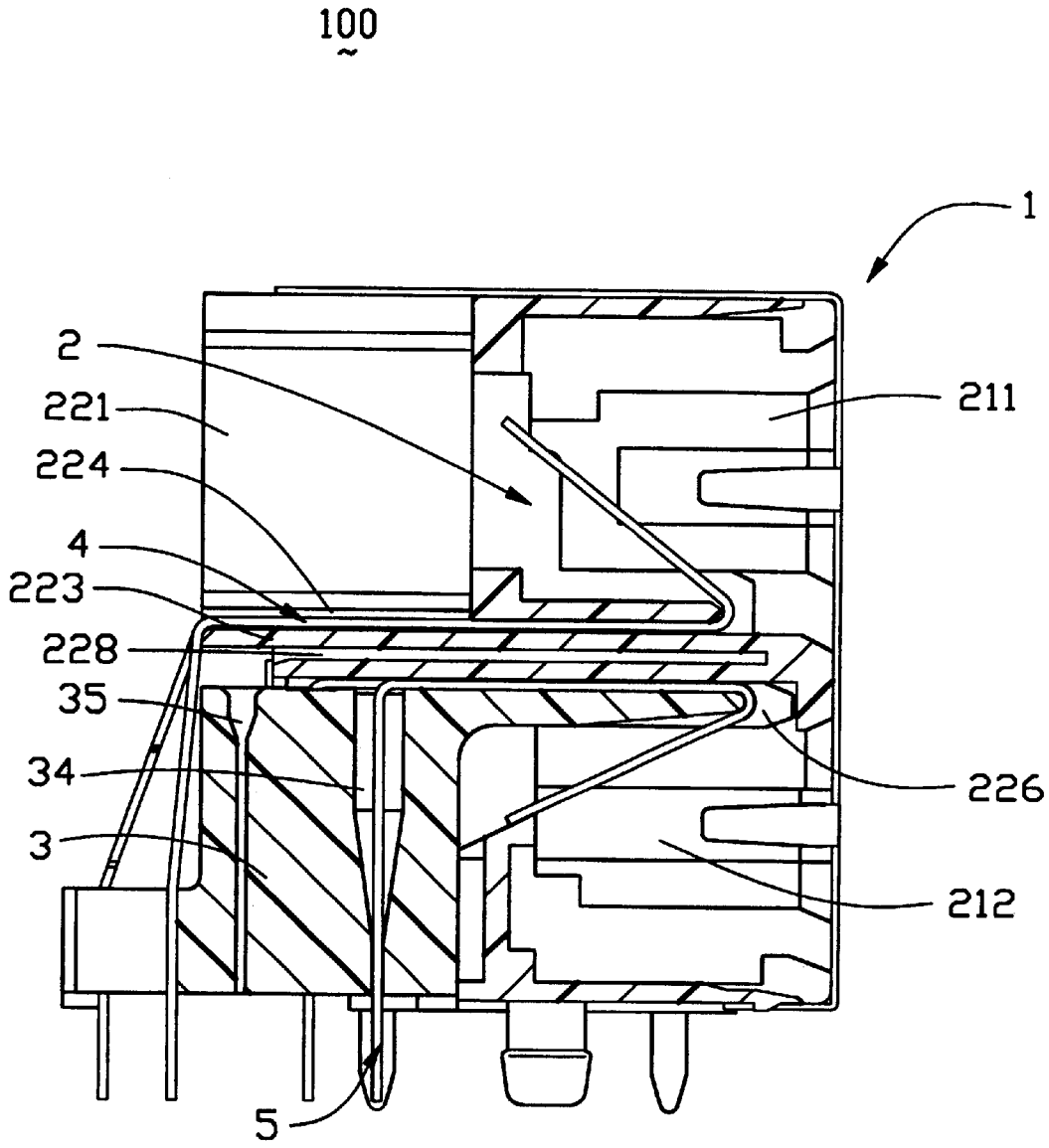
FIG. 4 is a cross-sectional view of the stacked modular jack assembly taken along line 4—4 of FIG. 2.

Referring to FIG. 1, a stacked modular jack assembly 100 comprises a shield 1, a dielectric housing 2, a Z-shaped insert 3 and a plurality of first and second contacts 4, 5. The housing 2 has a front face 21 having a first opening 211 and a second opening 212 (FIG. 3) and a rear face 22 having a third opening 222 and a fourth opening 221. A rearward extending projection 223 is formed between the third and fourth openings 222, 221. The projection 223 defines a plurality of channels 224 in a top face thereof and a slit 228 (FIG. 4). The housing 2 forms a plurality of apertures 225 corresponding to the channels 224 defined through the first and fourth openings 211, 221. The housing 2 also defines a pair of guiding recesses 226 and a pair of latches 227 below the recesses 226 in a periphery of the third opening 222. The housing 2 defines a pair of grooves 25 in outer surfaces thereof.

The shield 1 is stamped and bent from a thin sheet of metal material to be adapted for enclosing the housing 2. The shield 1 forms a pair of tabs 112 inwardly stamped from opposite sidewalls thereof and corresponding to the grooves 25 of the housing 2. The shield 1 also forms a pair of hooks 115 inwardly bent from bottom edges of opposite sidewalls thereof.

Figure 5:
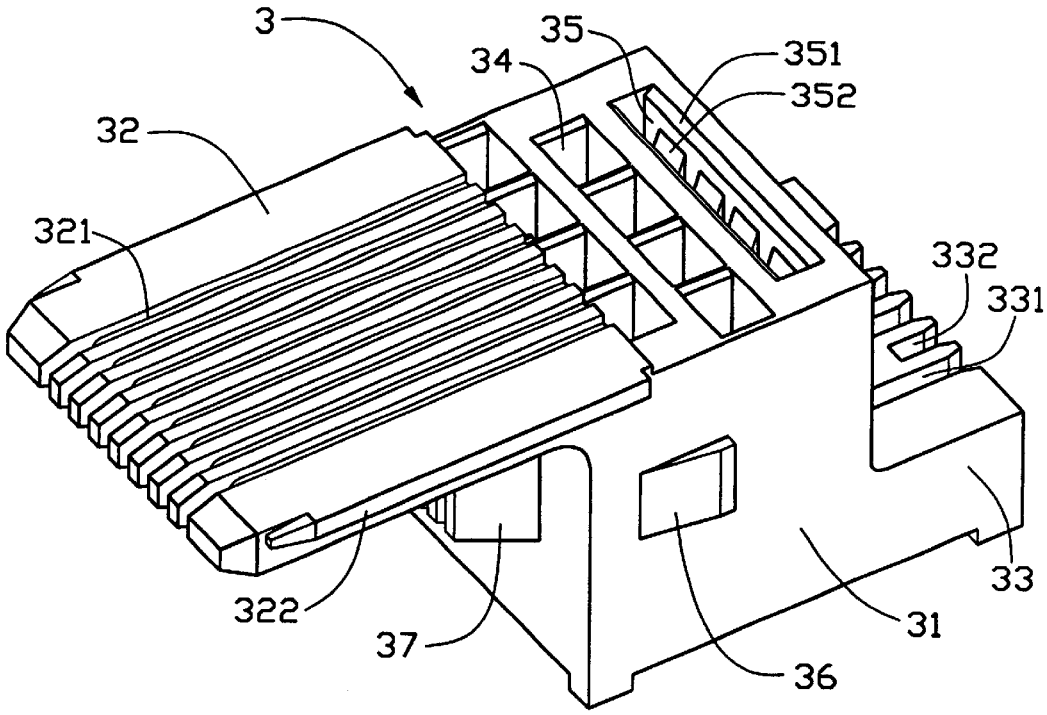
FIG. 5 is a perspective view of an insert of the stacked modular jack assembly of the present invention.

Also referring to FIG. 5, the insert 3 is a Z-shaped component comprising a body 31, a tongue 32 projecting from a top edge of the body 31 in one direction and a tail 33 projecting from a bottom edge of the body 31 in an opposite direction. The body 31 defines two rows of vertical cavities 34 through top and bottom faces thereof and a slot 35 proximate the cavities 34. The slot 35 forms a pair of bevels 351 at an opening thereof and several blocks 352 on opposite elongate walls thereof. A pair of wedges 36 is provided in opposite sidewalls of the body 31 for securing the insert 3 in the housing 1. The tongue 32 forms a plurality of level passages 321 in a top face thereof for receiving the second contacts 5. The tongue 32 also provides a pair of guiding bars 322 projecting from opposite edges thereof and having a smaller thickness than the tongue 32. The tail 33 forms several first notches 331 recessing a distance toward the body 31 and several second notches 332 recessing a shallower distance toward the body 31. The first and second notches 331, 332 are alternately arranged. The insert 3 further forms a plurality of barriers 37 extending from a bottom face of the tongue 32 and a front face of the body 31. The barriers 37 are distanced from a free end of the tongue.

Referring back to FIG. 1, the first and second contacts 4, 5 each respectively have a mating portion 41, 51, a retaining portion 42, 52 and a mounting portion 43, 53. The retaining portions 42, 52 are approximately level but the mating portions 41, 51 are respectively bent upwardly and downwardly. The mounting portions 43, 53 are bent downwardly to form two rows.

Also referring to FIGS. 2, 3, 4 and 5, the second contacts 5 are received in the insert 3 with the mounting portions 53 and the retaining portions 52 respectively received in the corresponding cavities 34 and the corresponding passages 321. Free ends of the mating portions 51 are separated from each other by the barriers 37 for preventing contact therebetween. The insert 3 together with the second contacts 5 is smoothly assembled to the housing by guidance of the bars 322 of the tongue 32 sliding along the recesses 226 of the housing 2. The insert 3 engages with the housing 2 whereby the wedges 36 thereof couple with the latches 227 and the mating portions 51 of the second contacts 5 are received in the second opening 212 of the housing 2 and abut a periphery of the second opening 212 thereby producing pre-leaded therebetween. The barriers 37 do not interfere with the assembly of the insert 3 into the housing 2 since they distanced from the free end of the tongue 32. The first contacts 4 are received in the housing 2 with the mating portions 41 thereof received in the corresponding apertures 225, the retaining portions 42 received in the corresponding channels 224 and the mounting portions 43 received in either the first or second notches 331, 332 in two rows. The shield 1 is assembled to the housing 2 with the tabs 112 thereof coupling with the grooves 25 of the housing 2 and the hooks 115 clasping bottom edges of the housing 2.

Figure 6:
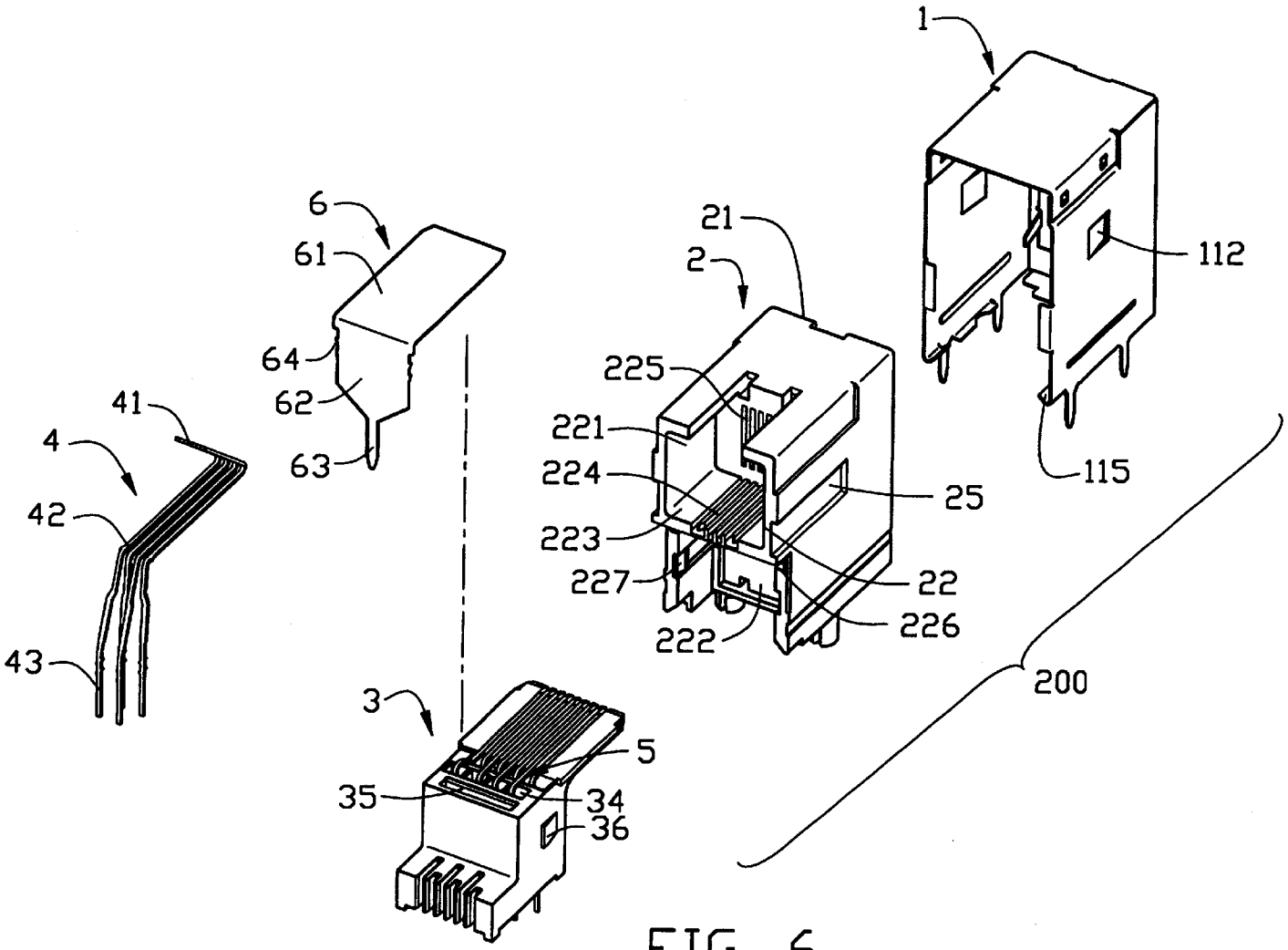
FIG. 6 is an exploded view of a stacked modular jack assembly in accordance with a second embodiment of the present invention.
Figure 7:
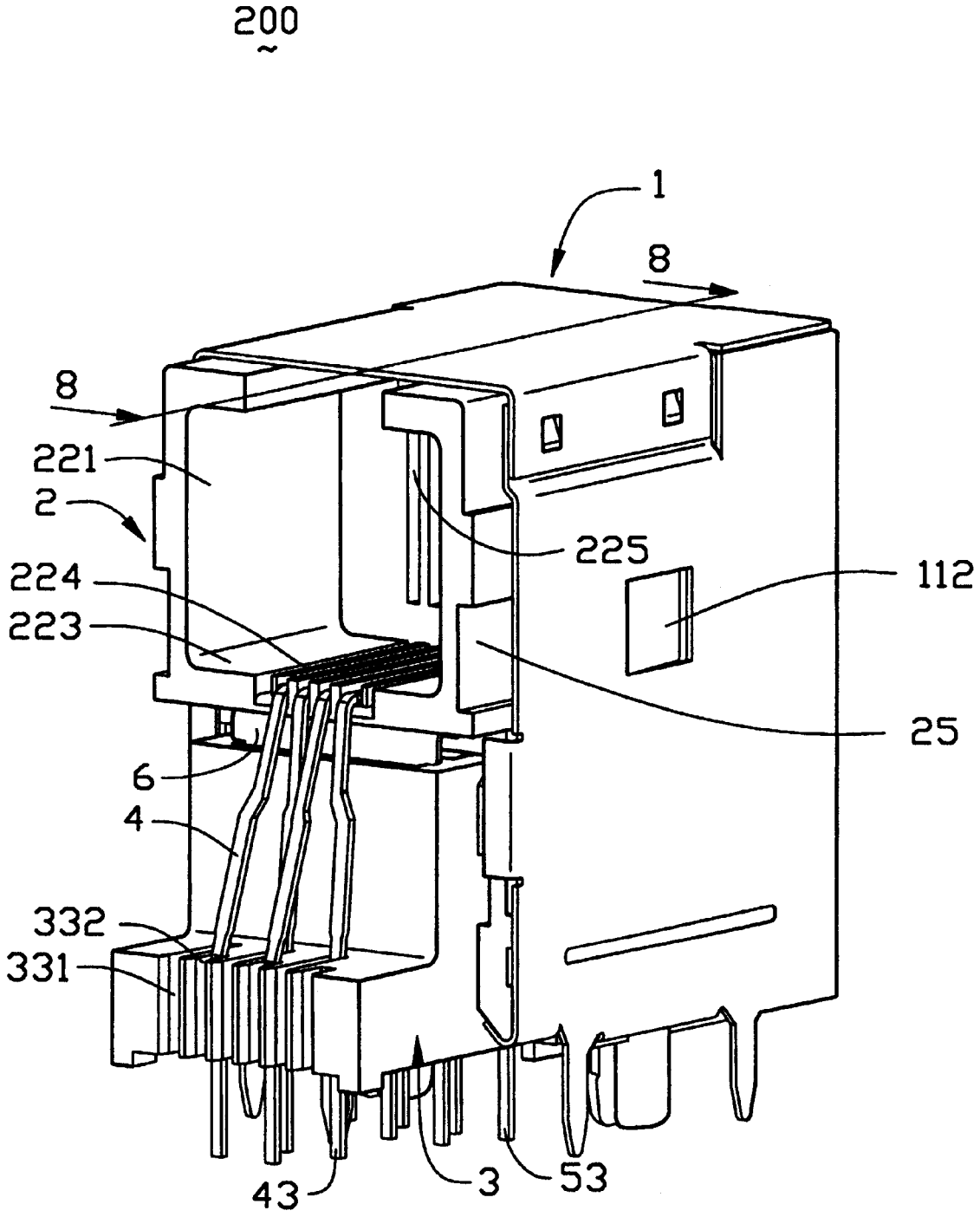
FIG. 7 is an assembled view of FIG. 6.
Figure 8:
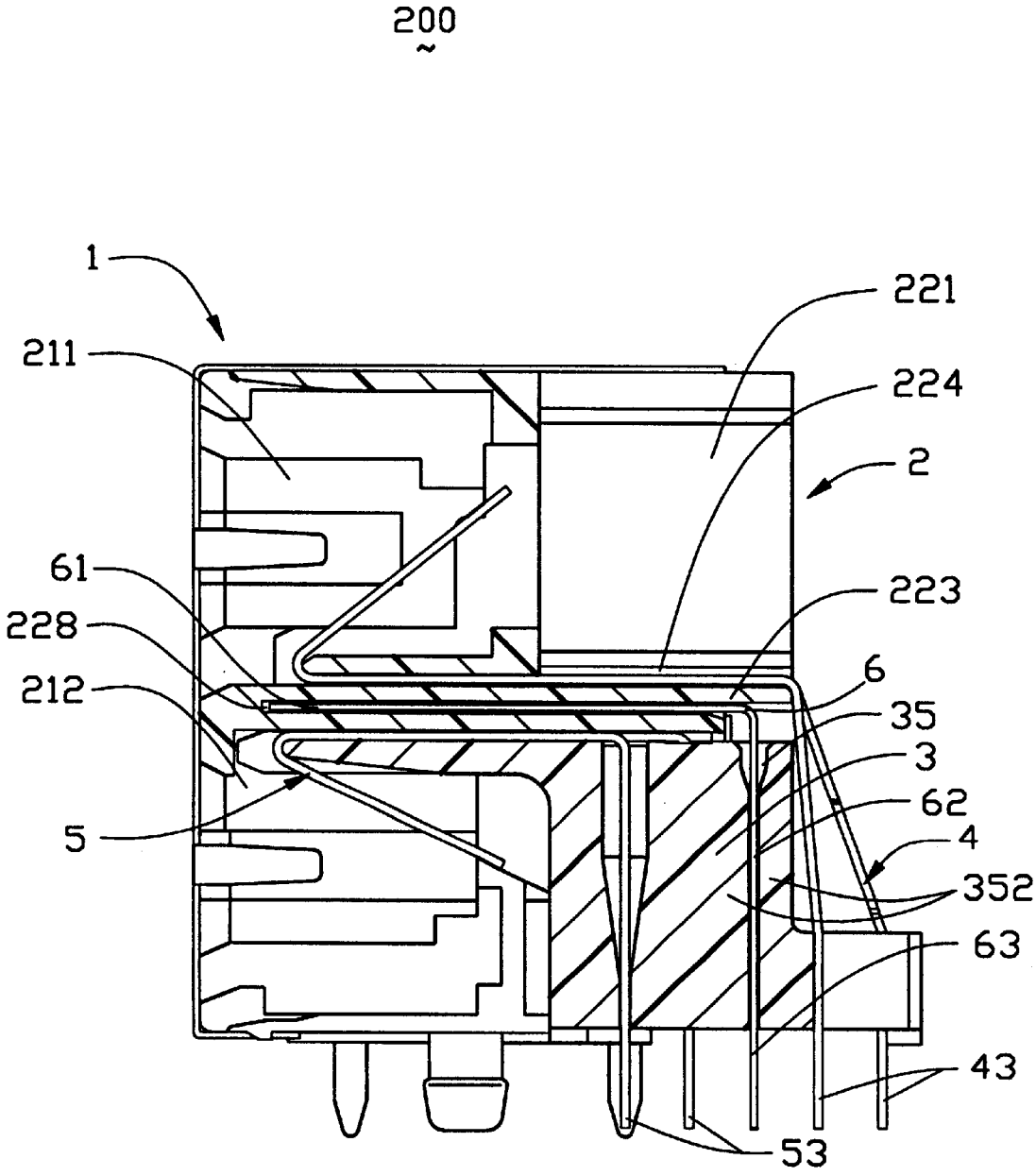
FIG. 8 is a cross-sectional view of the stacked modular jack assembly taken along line 8—8 of FIG. 7.

Referring to FIGS. 6, 7 and 8, a stacked modular jack 200 in accordance with a second embodiment of the present invention comprises a grounding plate 6 and all components described in the first embodiment. A description of the components shown in the first embodiment is omitted to avoid redundancy. The plate 6 comprises a cover 61, an interfering portion 62 perpendicularly extending from an edge of the cover 61 and a soldering portion 63 connected the interfering portion 62. The interfering portion 62 forms a plurality of barbs 64 on opposite edges thereof. The cover 61 is broader than the interfering portion 62 and the soldering portion 63 is much narrower than the interfering portion 62 for providing an excellent shielding function.

The interfering portion 62 is securely received in the slot 35 of the insert 3 with the barbs 64 thereof interfering with a periphery of the slot 35 and blocks 352 of the insert 3 abutting against opposite faces of the interfering portion 62. The soldering portion 63 extends beyond a bottom face of the housing 2 to electrically contact grounding means (not shown). The cover 61 is received in the slit 228 of the housing 2 to prevent cross talk between the first and second contacts 4, 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked modular jack assembly comprising:

a dielectric housing having a front face and a rear face, the front face defining a first opening and a second opening spaced from each other by a projection therebetween and adapted for receiving first and second mating connectors, the rear face defining a third opening, a plurality of contact receiving channels being defined between the front and rear faces of the housing;

a plurality of first and second connector contacts for respectively electrically engaging with the first and second mating connectors, each contact having a mating portion, a retaining portion and a mounting portion, the mating portions of the first and second connector contacts respectively extending into the first and second openings of the housing, the retaining portions of the first connector contacts being positioned in corresponding channels of the housing; and an insert comprising a body receiving the mounting portions of the second connector contacts therein, a tongue extending from an edge of the body and being received in the third opening in the rear face of the housing, and a plurality of barriers separating free ends of the mating portions of the second connector contacts, the tongue defining a plurality of horizontal passages on a top face thereof for engageably receiving the retaining portions of the second connector contacts, wherein the insert forms a tail extending from the body opposite the tongue, the tail defining a plurality of notches retaining the mounting portions of the first connector contacts; wherein the insert further defines a vertical slot proximate the cavities; wherein said stacked modular jack assembly further includes a grounding plate which has a cover positioned between the first and second contacts, an interfering portion received in the slot of the insert and a soldering portion extending beyond the insert; wherein the cover of the grounding plate is broader than the infering portion and the soldering portion is much narrower than the interfering portion.

2. The stacked modular jack assembly as claimed in claim 1, wherein the barriers extend from a bottom face of the tongue and a front face of the body.

3. The stacked modular jack assembly as claimed in claim 2, wherein the barriers are distanced from a free end of the tongue.

4. The stacked modular jack assembly as claimed in claim 1 further comprising a shield enclosing the housing.

5. The stacked modular jack assembly as claimed in claim 1, wherein the cover of the grounding plate is perpendicular to the interfering portion of the plate.

6. The stacked modular jack assembly as claimed in claim 1, wherein the interfering portion of the grounding plate forms a plurality of barbs on opposite edges thereof for providing reliable engagement between the grounding plate and the insert.

7. The stacked modular jack assembly as claimed in claim 1, wherein the slot of the insert is adapted for receiving the grounding plate and forms bevels at an opening thereof for facilitating insertion of the grounding plate into the slot.

8. The stacked modular jack assembly as claimed in claim 1, wherein the slot forms a plurality of blocks on opposite elongate walls thereof.

9. A stacked modular jack assembly comprising:

a dielectric housing defining a front face and a rear face, said front face defining a first opening and a second opening adapted to receive first and second mating connectors, a plurality of contact receiving channels being defined between the front and the rear faces of the housing;

a plurality of first contacts positioned in the corresponding contact receiving channels, each of said first contacts including a first mating portion extending into the first opening in a first slanted manner, and a first mounting portion opposite to said first mating portion;

a plurality of second contacts positioned below the first contacts in the housing, each of said second contacts including a second mating portion and an opposite second mounting portion, said mating portion extending into the second opening in a second slanted manner which is a mirror-image of the first slanted manner;

an insert comprising a body receiving the mounting portions of the second contacts therein, a tongue extending forward from the body into the second opening and with said second mating portions of the second contacts extending therefrom, and a tail projecting rearwardly from the body opposite to the tongue, said tail defining a plurality of notches receiving the mounting portions of the first contacts therein, respectively;

means for horizontally assembling the insert to the housing; and a grounding plate positioned between said first contacts and said second contacts, the grounding plate defining two opposite ends, of which one is retainably received within the insert while the other is received within the housing.

10. The assembly as claimed in claim 9, wherein said second contacts are first assembled to the insert, and then successively assembled to the housing with said the associated insert.

11. A stacked modular jack assembly comprising:

a dielectric housing having a front face and a rear face, the front face defining a first opening and a second opening adapted for receiving first and second mating connectors, the rear face defining a third opening, a plurality of contact receiving channels being defined between the front and rear faces of the housing;

a plurality of first and second contacts each having a mating portion, a retaining portion and a mounting portion, the mating portions of the first and second contacts respectively extending into the first and second openings of the housing, the retaining portions of the first contacts being positioned in corresponding channels of the housing;

an insert comprising a body receiving the mounting portions of the second contacts, a tongue received in the third opening of the housing, and a plurality of barriers separating free ends of the mating portions of the second contacts, the tongue defining a plurality of horizontal passages ona top face thereof for receiving the retaining portions of the second contacts, the insert further defining a vertical slot proximate the cavities; and a grounding plate having a cover positioned between the first and second contacts, an interfering portion received in the slot of the insert and a soldering portion extending beyond the insert; wherein the slot of the insert is adapted for receiving the grounding plate and forms bevels at an opening thereof for facilitating insertion of the grounding plate into the slot.

* * * * *